US012760234B2

(12) United States Patent
Zhao

(10) Patent No.: US 12,760,234 B2
(45) Date of Patent: Oct. 13, 2026

(54) POLYETHERAMINE SALTS AND THEIR USE AS CORROSION INHIBITORS AND FRICTION REDUCERS

(71) Applicant: Huntsman Petrochemical LLC, The Woodlands, TX (US)

(72) Inventor: Haibo Zhao, The Woodlands, TX (US)

(73) Assignee: HUNTSMAN PETROCHEMICAL LLC, The Woodlands, TX (US)

( * ) Notice: Subject to any disclaimer, the term of this patent is extended or adjusted under 35 U.S.C. 154(b) by 0 days.

(21) Appl. No.: 18/025,496

(22) PCT Filed: Aug. 27, 2021

(86) PCT No.: PCT/US2021/047847
§ 371 (c)(1),
(2) Date: Mar. 9, 2023

(87) PCT Pub. No.: WO2022/060554
PCT Pub. Date: Mar. 24, 2022

(65) Prior Publication Data

US 2023/0365880 A1 Nov. 16, 2023

Related U.S. Application Data

(60) Provisional application No. 63/079,155, filed on Sep. 16, 2020.

(51) Int. Cl.
*C10L 1/2387* (2006.01)
*C10L 1/222* (2006.01)
(Continued)

(52) U.S. Cl.
CPC ..... *C10L 1/2387* (2013.01); *C10L 1/2222* (2013.01); *C10L 10/04* (2013.01); *C10L 10/08* (2013.01);
(Continued)

(58) Field of Classification Search
CPC ..... C10L 1/14; C10L 1/143; C10L 1/1881; C10L 1/1883; C10L 1/1895;
(Continued)

(56) References Cited

U.S. PATENT DOCUMENTS 3,654,370 A 4/1972 Yeakey
4,589,992 A 5/1986 Phillips et al.
(Continued)

FOREIGN PATENT DOCUMENTS

CN 1539929 A 10/2004
EP 0115110 A1 8/1984
(Continued)

OTHER PUBLICATIONS

First Office Action issued Jan. 28, 2025, in corresponding Chinese Application No. 202180063113.4.
(Continued)

*Primary Examiner* — Latosha Hines

(57) ABSTRACT

The present disclosure generally relates to a fuel additive composition for use in reducing corrosion and wear in an internal combustion engine or fuel component part thereof. The fuel additive composition includes a polyetheramine salt obtained by either (a) mixing a polyoxyalkylene monoamine and at least one of a dicarboxylic acid or a tricarboxylic acid or (b) mixing a polyoxyalkylene polyamine and at least one of a monocarboxylic acid, the dicarboxylic acid, or the tricarboxylic acid.

10 Claims, 1 Drawing Sheet

(51) Int. Cl.
*C10L 10/04* (2006.01)
*C10L 10/08* (2006.01)

(52) U.S. Cl.
CPC ..... *C10L 2200/0254* (2013.01); *C10L 2200/0423* (2013.01); *C10L 2270/023* (2013.01)

(58) Field of Classification Search
CPC .... C10L 1/2222; C10L 1/2235; C10L 1/2387; C10L 10/04; C10L 10/08; C10L 2200/0254; C10L 2200/0423; C10L 2270/023
See application file for complete search history.

(56) References Cited

U.S. PATENT DOCUMENTS

| | | | | |
|---|---|---|---|---|
| 4,623,014 | A | 11/1986 | Faessler et al. | |
| 5,064,571 | A * | 11/1991 | Speranza | C23F 11/145 252/61 |
| 5,112,364 | A | 5/1992 | Rath et al. | |
| 2004/0010967 | A1 * | 1/2004 | Aradi | C10L 10/08 44/403 |
| 2008/0202561 | A1 | 8/2008 | DuMont et al. | |
| 2010/0146845 | A1 | 6/2010 | Burgazil et al. | |
| 2012/0311922 | A1 | 12/2012 | Tinetti et al. | |
| 2013/0227878 | A1 | 9/2013 | Wolf et al. | |
| 2016/0032208 | A1 * | 2/2016 | Bartley | C10L 1/18 44/385 |
| 2017/0145334 | A1 * | 5/2017 | Sugimoto | C10L 1/2222 |
| 2018/0251692 | A1 | 9/2018 | Mezger et al. | |
| 2019/0218467 | A1 | 7/2019 | Huo et al. | |

FOREIGN PATENT DOCUMENTS

| | | | |
|---|---|---|---|
| EP | 0412702 | A2 | 2/1991 |
| EP | 1471131 | A1 | 10/2004 |
| EP | 3216846 | A1 | 5/2019 |
| JP | 1991-118356 | A | 5/1991 |
| JP | 2004-323821 | A | 11/2004 |
| JP | 2016-89076 | A | 5/2016 |
| WO | 2017192514 | A1 | 11/2017 |
| WO | 2020172001 | A1 | 8/2020 |

OTHER PUBLICATIONS

Extended European Search Report issued Sep. 9, 2024, in corresponding European Application No. 21869969.2.
First Office Action issued Sep. 17, 2025, in corresponding Japanese Application No. 2023-517667 (Machine English Translation enclosed herewith).

* cited by examiner

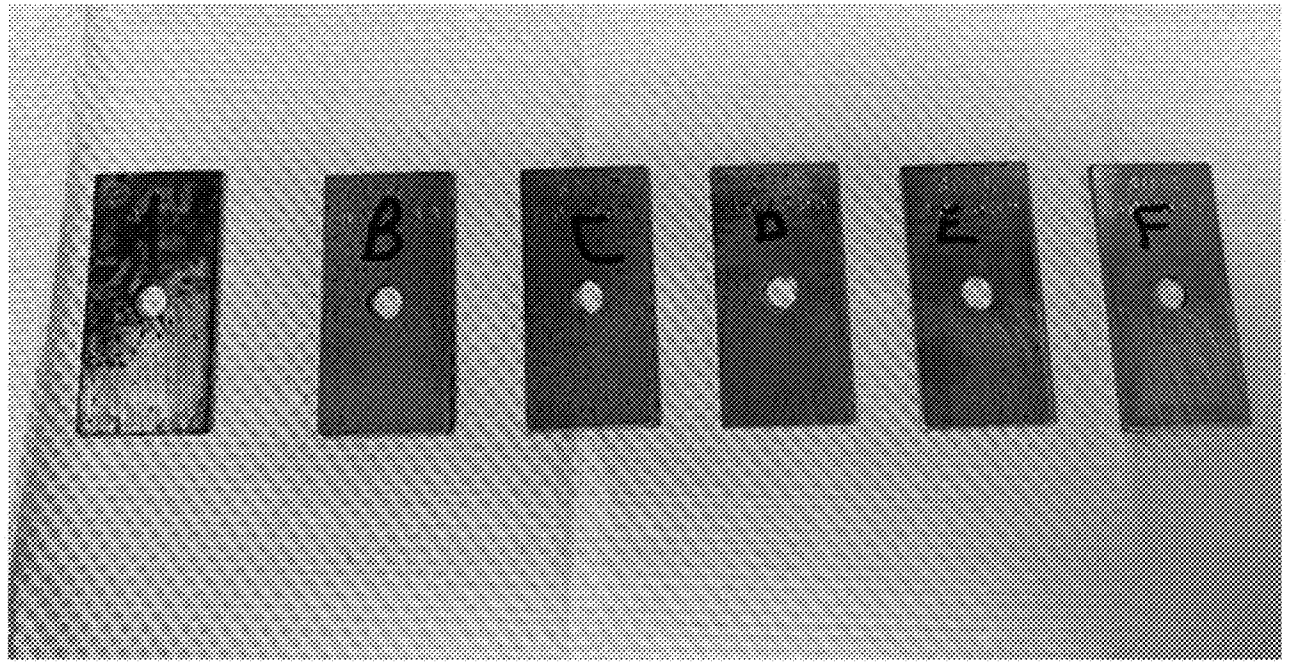
A
B
C
D
E
F

POLYETHERAMINE SALTS AND THEIR USE AS CORROSION INHIBITORS AND FRICTION REDUCERS

CROSS-REFERENCE TO RELATED APPLICATION

This application is the National Phase of International Application PCT/US2021/047847 filed Aug. 27, 2021 which designated the U.S. and which claims priority to U.S. Provisional Application 63/079,155 filed Sep. 16, 2020. The noted application(s) are incorporated herein by reference.

STATEMENT REGARDING FEDERALLY SPONSORED RESEARCH OR DEVELOPMENT

Not applicable.

FIELD

The present disclosure generally relates to a fuel additive composition comprising a polyetheramine salt obtained by either: (a) mixing a polyoxyalkylene monoamine and at least one of a dicarboxylic acid or a tricarboxylic acid; or (b) mixing a polyoxyalkylene polyamine and at least one of a monocarboxylic acid, the dicarboxylic acid, or the tricarboxylic acid. The fuel additive composition may be useful as a corrosion inhibitor and friction modifier in fuel compositions containing a hydrocarbonaceous composition.

BACKGROUND

There has been a strong push from regulatory authorities in many countries to reduce vehicle emission by reducing the level of sulfur in fuels. During processes for reducing such levels, many of the aromatic and polar molecules that have been added to the fuel to increase its lubricity and therefore reduce wear in fuel pumps and injectors are also removed. Accordingly, without these molecules present, the durability of fuel pumps and injectors is greatly reduced. Moreover, gasoline direct injection (GDI) engines have recently replaced portable fuel injection (PFI) engines and the higher pressures and temperatures encountered in such fuel delivery systems can further exacerbate engine wearing problems.

In addition, corrosion inhibitors are also often added to fuels to prevent corrosion in storage tanks, pipelines and engines. Corrosion in storage tanks and pipeline systems usually stems from water contamination in the fuels. In the case of gasoline-oxygenate blends, corrosion problems can also stem from acidic impurities that are found in the oxygenate. While effective in reducing corrosion, these inhibitors generally show very little friction reducing characteristics to offset the problems described above.

While state of the art corrosion inhibitors and wear reducing agents may be suitable for particular applications, a need exists for the development of alternative compounds that are capable of providing both corrosion inhibition and friction reduction and which, when added to fuels at low concentrations, do not introduce undesirable side effects into the fuel systems and engines in which they are used.

SUMMARY

The present disclosure generally provides a fuel additive composition for reducing corrosion and increasing lubricity in hydrocarbonaceous compositions that are in contact with a fuel system component part or internal combustion engine comprising a polyetheramine salt obtained by either: (a) mixing a polyoxyalkylene monoamine and at least one of a dicarboxylic acid or a tricarboxylic acid; or (b) mixing a polyoxyalkylene polyamine and at least one of a monocarboxylic acid, the dicarboxylic acid, or the tricarboxylic acid.

In still another embodiment, there is provided a corrosion and friction inhibiting fuel composition comprising the fuel additive composition of the present disclosure and a hydrocarbonaceous composition.

In yet another embodiment, there is provided a method for preventing corrosion and wear reduction of a metal, plastic or synthetic part or surface of a fuel system component or internal combustion engine by combining an effective amount of the fuel additive composition with a hydrocarbonaceous composition to form a fuel composition, and contacting the metal, plastic or synthetic part or surface with the fuel composition during operation of the engine.

BRIEF DESCRIPTION OF THE DRAWINGS

FIG. 1 depicts the anti-corrosion properties of the inventive fuel additive compositions of the present disclosure.

DETAILED DESCRIPTION

The present disclosure is generally directed to a fuel additive composition comprising a polyetheramine salt obtained by either: (a) mixing a polyoxyalkylene monoamine and at least one of a dicarboxylic acid or a tricarboxylic acid; or (b) mixing a polyoxyalkylene polyamine and at least one of a monocarboxylic acid, the dicarboxylic acid, or the tricarboxylic acid. The fuel additive composition of the present disclosure, when added to a hydrocarbonaceous composition, has surprisingly been found to be capable of preventing or significantly reducing the amount of corrosion formed on a surface that is in contact with the hydrocarbonaceous composition. Additionally, the fuel additive composition, when added to the hydrocarbonaceous composition, has surprisingly been found to increase the lubricity of the hydrocarbonaceous composition and therefore is capable of greatly reducing the wear on internal combustion engine surfaces or fuel system components that are in contact with or have been contacted by the hydrocarbonaceous composition. The multifunctional nature of the fuel additive composition according to the present disclosure enables it to be used, in some embodiments, in the substantial absence of any additional state of the art corrosion inhibitors or friction modifiers.

Thus, use of the fuel additive composition in hydrocarbonaceous compositions during operation of an internal combustion engine may result in a considerable reduction in corrosion and wear in the fuel system components and around the piston walls of the combustion engine. The reduction in friction should further result in improved fuel economy. Wear and corrosion of fuel system components and combustion engine limits their useful life and may be costly given that they are expensive to produce. Additionally, such corrosion and wear may result in down time, reduced safety and a decrease in reliability and use of the fuel additive composition may reduce such corrosion and wear thereby increasing the lifetime of these components and engine.

The following terms shall have the following meanings:

The term "comprising" and derivatives thereof are not intended to exclude the presence of any additional component, step or procedure, whether or not the same is disclosed herein. In order to avoid any doubt, all compositions claimed herein through use of the term "comprising" may include any additional additive, adjuvant, or compound, unless stated to the contrary. In contrast, the term, "consisting essentially of" if appearing herein, excludes from the scope of any succeeding recitation any other component, step or procedure, except those that are not essential to operability and the term "consisting of", if used, excludes any component, step or procedure not specifically delineated or listed. The term "or", unless stated otherwise, refers to the listed members individually as well as in any combination.

The articles "a" and "an" are used herein to refer to one or to more than one (i.e. to at least one) of the grammatical objects of the article. By way of example, "a polyetheramine" means one polyetheramine or more than one polyetheramine. The phrases "in one embodiment", "according to one embodiment" and the like generally mean the particular feature, structure, or characteristic following the phrase is included in at least one embodiment of the present disclosure, and may be included in more than one embodiment of the present disclosure. Importantly, such phrases do not necessarily refer to the same aspect. If the specification states a component or feature "may", "can", "could", or "might" be included or have a characteristic, that particular component or feature is not required to be included or have the characteristic.

The term "about" as used herein can allow for a degree of variability in a value or range, for example, it may be within 10%, within 5%, or within 1% of a stated value or of a stated limit of a range.

Values expressed in a range format should be interpreted in a flexible manner to include not only the numerical values explicitly recited as the limits of the range, but to also include all of the individual numerical values or sub-ranges encompassed within that range as if each numerical value and sub-range is explicitly recited. For example, a range such as from 1 to 6, should be considered to have specifically disclosed sub-ranges, such as, from 1 to 3, from 2 to 4, from 3 to 6, etc., as well as individual numbers within that range, for example, 1, 2, 3, 4, 5, and 6. This applies regardless of the breadth of the range.

The terms "preferred" and "preferably" refer to embodiments that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the present disclosure.

The term "hydrocarbonaceous composition" refers to petroleum (crude oil), or liquid fuels such as gasoline, diesel, biodiesel, kerosene, naphtha, water-fuel emulsions, ethanol-based fuels and ether-based fuels.

The term "fuel system components" as used herein means all the accessories that are interposed and connected to the fuel system of an internal combustion engine (engine), and includes, for example, a canister, a fuel filter, a fuel pump and the like.

The term "corrosion" refers to any degradation, rusting, weakening, deterioration or softening of any surface, including storage tanks, pipelines, engine surfaces or a fuel system component due to exposure to or combustion of a hydrocarbonaceous composition.

The term "corrosion inhibition" or "reducing corrosion" refers to any improvement in minimizing, reducing, eliminating or preventing corrosion.

The term "friction reduction" or "reducing friction" refers to a reduction in frictional losses due to friction between a hydrocarbonaceous composition and a storage tank, pipeline, engine surface or fuel system component due to exposure to or combustion of a hydrocarbonaceous composition.

The term "alkyl" includes a straight or branched saturated aliphatic hydrocarbon chain having from 1 to 24 carbon atoms, such as, for example, methyl, ethyl, propyl, isopropyl, (1-methylethyl), butyl, tert-butyl (1,1-dimethylethyl), and the like.

The term "alkenyl' includes an unsaturated aliphatic hydrocarbon chain having from 2 to 24 carbon atoms, such as, for example, ethenyl, 1-propenyl, 2-propenyl, 1-butenyl, 2-methyl-1-propenyl, and the like.

The above alkyl or alkenyl can be terminally substituted with a heteroatom, such as, for example, a nitrogen, sulfur, or oxygen atom, forming an aminoalkyl, oxyalkyl, or thioalkyl, for example, aminomethyl, thioethyl, oxypropyl, and the like. Similarly, the above alkyl or alkenyl can be interrupted in the chain by a heteroatom forming an alkylaminoalkyl, alkylthioalkyl, or alkoxyalkyl, for example, methylaminoethyl, ethylthiopropyl, methoxymethyl, and the like.

The term "alicyclic" includes any cyclic hydrocarbyl containing from 3 to 8 carbon atoms. Examples of suitable alicyclic groups include cyclopropanyl, cyclobutanyl, cyclopentyl and the like.

The term "heterocyclic" includes any cyclic hydrocarbyl containing from 3 to 8 carbon atoms that is interrupted by a heteroatom, such as, for example, a nitrogen, sulfur, or oxygen atom. Examples of heterocyclic groups include groups derived from tetrahydrofurans, furans, thiophenes, pyrrolidines, piperidines, pyridines, pyrrols, picoline and coumaline.

Alkyl, alkenyl, alicyclic groups, and heterocyclic groups can be unsubstituted or substituted by, for example, aryl, heteroaryl, $C_1$-$C_4$ alkyl, $C_1$-$C_4$ alkenyl, $C_1$-$C_4$ alkoxy, amino, carboxy, halo, nitro, cyano. —SOH, phosphono, or hydroxy. When alkyl, alkenyl, alicyclic group, or heterocyclic group is substituted, preferably the substitution is $C_1$-$C_4$ alkyl, halo, nitro, amido, hydroxy, carboxy, sulpho or orphosphono.

The term "aryl' includes aromatic hydrocarbyl, including fused aromatic rings, such as, for example, phenyl and naphthyl.

The term "heteroaryl' includes heterocyclic aromatic derivatives having at least one heteroatom such as, for example, nitrogen, oxygen, phosphorus, or sulfur, and includes, for example, furyl, pyrrolyl, thienyl, oxazolyl, pyridyl, imidazolyl, thiazolyl, isoxazolyl pyrazolyl and isothiaxolyl.

The term "heteroaryl also includes fused rings in which at least one ring is aromatic, such as, for example, indolyl, purinyl and benzofuryl.

Aryl and heteroaryl groups can be unsubstituted or substituted on the ring by, for example, aryl, heteroaryl, alkyl, alkenyl, alkoxy, amino, carboxy, halo, nitro, cyano, —SOH, phosphono or hydroxy. When aryl, aralkyl, or heteroaryl is substituted, preferably the substitution is $C_1$-$C_4$ alkyl, halo, nitro, amido, hydroxy, carboxy, sulpho or orphosphono Where substituent groups are specified by their conventional chemical formula, written from left to right, they equally encompass the chemically identical substituents that would result from writing the structure from right to left, for example, —$CH_2O$— is equivalent to —$OCH_2$—.

The term "optional" or "optionally" means that the subsequently described event or circumstance may or may not occur, and that the description includes instances where said event or circumstance occurs and instances where it does not.

According to one embodiment, the polyetheramine salt of the fuel additive composition may be obtained by either: (a) mixing a polyoxyalkylene monoamine and at least one of a dicarboxylic acid or a tricarboxylic acid; or (b) mixing a polyoxyalkylene polyamine and at least one of a monocarboxylic acid, the dicarboxylic acid, or the tricarboxylic acid.

In one embodiment, the polyoxyalkylene monoamine is a compound containing one amino group that is attached to the terminus of a polyether backbone. The amino group may be a primary (—$NH_2$) or a secondary (—NH—) amino group. In one embodiment, the amino group is a primary amino group. As further discussed below, the polyether backbone is based on, i.e., further defined by, alkylene oxide groups, such as propylene oxide (PO), ethylene oxide (EO), butylene oxide (BO) and mixtures thereof. In mixed structures, the ratios can be in any desired ratio and may be arranged in blocks (for e.g. repeating or alternating) or randomly distributed. In one non-limiting example, in a mixed EO/PO structure, the ratio of EO:PO can range from about 1:1 to about 1:50 and vice-versa. As such, the polyoxyalkylene monoamine may substantially define a polyethylene oxide, polypropylene oxide, and/or a polybutylene oxide. The molecular weights of the polyoxyalkylene monoamines can vary and may range up to a molecular weight of about 6,000.

The polyoxyalkylene monoamine may generally be prepared by reaction of a monohydric initiator, for e.g. an alcohol, with ethylene and/or propylene oxide and/or butylene oxide. This reaction is followed by conversion of the resulting terminal hydroxyl group to an amine, thereby providing a polyether backbone which includes propylene oxide (PO), ethylene oxide (EO), butylene oxide (BO) or mixtures thereof, and a terminal amino group, for e.g., a terminal primary amino group or a terminal secondary amino group, preferably a primary amino group. According to one embodiment, the alcohol may be an aliphatic having 1-35 carbon atoms or aromatic alcohol having from 6-35 carbon atoms, both of which may be further substituted with moieties such as alkyl, aryl, arylalkyl and alkaryl substituents. In another embodiment, the alcohol is an alkanol having 1-18 carbon atoms, or 1-10 carbon atoms, such as lower alkyl derived alkanols including for example, methanol, ethanol, propanol, butanol, isopropanol, sec-butanol and the like. In another embodiment, the alcohol may be an alkylphenol where the alkyl substituent is a straight or branched chain alkyl of from 1-24 carbon atoms such as from 4-16 carbon atoms, or an aryl substituted phenol including mono-di- and tri-phenyl-phenol, or an alkaryl phenol, or an arylalkylphenol such as tri-strylphenol, or naphthol, or an alkyl substituted naphthol.

According to one particular embodiment, the polyoxyalkylene monoamine is a compound having a general formula:

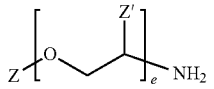

where Z is a $C_1$-$C_{40}$ alkyl group or a $C_1$-$C_{40}$ alkyl phenol group; each Z' is independently hydrogen, methyl or ethyl; and e is an integer from about 1 to about 50. Particular examples include, but are not limited to compounds having the formulae:

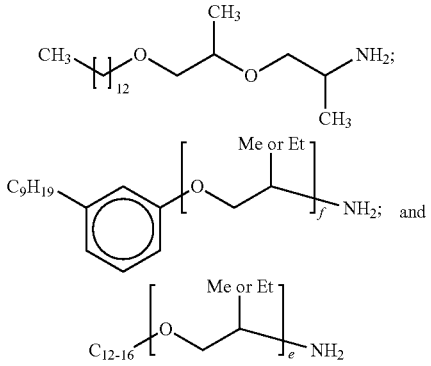

where Me is methyl and Et is ethyl; f is an integer from about 13 to about 14; and e is an integer from about 2 to about 3. Such polyoxyalkylene monoamines included within the above formulas include the JEFFAMINE® M-600, M-1000, M-2005, M-2070, FL-1000 (where f is 14 and Me or Et is methyl), C-300 (where e is about 2.5); XTJ-435 and XTJ-436 amines.

According to another embodiment, the polyoxyalkylene polyamine is a polyoxyalkylene diamine. Procedures for making polyoxyalkylene diamines are described in, for example, U.S. Pat. No. 3,654,370, the contents of which are incorporated herein by reference. In one particular embodiment, the polyoxyalkylene diamine is an amine terminated polyoxyalkylene diol. The polyether backbone for such polyoxyalkylene diols can include ethylene oxide, propylene oxide, butylene oxide or mixtures thereof and thus the polyoxyalkylene primary diamine may have a general formula

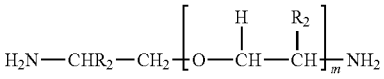

where m is an integer of 2 to about 100 and each $R_2$ is independently hydrogen, methyl or ethyl. In some embodiments, each $R_2$ is independently hydrogen or methyl and m is an integer of 2 to about 70, or 2 to about 35 or 2 to about 7. In other embodiments, each $R_2$ is independently hydrogen or methyl and m is an integer of 6 to about 70 or about 6 to about 35. In still further embodiments, each $R_2$ is methyl and m is an integer of 2 to about 70. Examples of these compounds include the JEFFAMINE® D-series amines available from Huntsman Petrochemical LLC, such as JEFFAMINE® D-230 amine where $R_2$ is methyl and m is about 2.6, and JEFFAMINE® D400 amine where $R_2$ is methyl and m is about 6.1, as well analogous compounds offered by other companies comprising polyoxyalkylene primary diamines.

In another embodiment, embodiment, the polyoxyalkylene diamine has a general formula

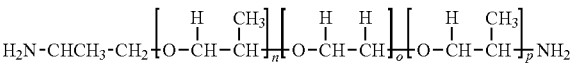

where n and p are each independently integers from about 1 to about 10 and o is an integer from about 2 to about 40. In some embodiments, o is an integer of about 2 to about 40, or about 2 to about 13 or about 2 to about 10. In another embodiment, o is an integer of about 9 to about 40, or about 12 to about 40 or about 15 to about 40, or even about 25 to about 40. In other embodiments, n+p is an integer within a range of about 1 to about 6, or within a range of about 1 to about 4 or within a range of about 1 to about 3. In further embodiments, n+p is an integer within a range of about 2 to about 6 or within a range of about 3 to about 6. Examples of these compounds include the JEFFAMINE® ED-series amines available from Huntsman Petrochemical LLC, as well analogous compounds offered by other companies comprising polyoxyalkylene primary diamines.

In still another embodiment, another embodiment, the polyoxyalkylene diamine may have the formula

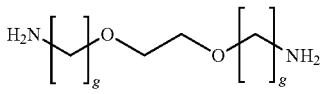

where g is an integer from about 2 to about 3. Examples of these compounds include the JEFFAMINE® EDR-series amines available from Huntsman Petrochemical LLC, as well analogous compounds offered by other companies comprising polyoxyalkylene primary diamines.

In yet another embodiment, another embodiment, the polyoxyalkylene polyamine is a polyoxyalkylene triamine. The polyoxyalkylene triamine similarly can be ethylene oxide, propylene oxide or butylene oxide based, as well as mixtures thereof, and may be prepared by the reaction of such oxides with a triol initiator (for e.g. glycerin or trimethylolpropane), followed by amination of the terminal hydroxyl groups. In one embodiment the polyoxyalkylene triamine may have a general formula

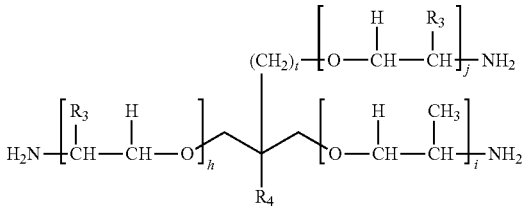

where each $R_3$ is independently hydrogen, methyl or ethyl, $R_4$ is hydrogen, methyl or ethyl, t is 0 or 1 and h, i and j independently are integers from about 1 to about 100. In one embodiment, $R_4$ is hydrogen or ethyl. In another embodiment, each $R_3$ is independently hydrogen or methyl, and in some embodiments each $R_3$ is methyl. In still another embodiment, h+i+j is an integer within a range of about 1 to about 100 or within a range of about 5 to about 85. Examples of these compounds include the JEFFAMINE® T-series amines available from Huntsman Petrochemical LLC, such as JEFFAMINE® T3000 where $R_3$ is methyl, $R_4$ is hydrogen, t is 0 and h+i+j is 50, as well analogous compounds offered by other companies comprising polyoxyalkylene primary triamines.

The polyetheramine salt of the present disclosure can be prepared by mixing the polyoxyalkylene monoamine or polyamine with a carboxylic acid at a complete ratio of salting and at ambient conditions or elevated temperatures with mild agitation. The carboxylic acid may be saturated or unsaturated with a linear and/or branched chain. It may be natural or synthetic and may be aliphatic or aromatic. The carboxylic acid includes any compound of the formula $R—(COOH)_n$ in which R can be hydrogen, alkyl, alkenyl, alicyclic group, aryl, heteroaryl, or a heterocyclic group, and n is 1, 2, or 3.

In one embodiment, the carboxylic acid is a monocarboxylic acid. Preferably the monocarboxylic acid has $C_1$-$C_{24}$ alkyl groups. Examples of monocarboxylic acids include, but are not limited to, formic, acetic, propanoic, isopropanoic, butanoic, pentanoic, isopentanoic, neopentanoic, hexanoic, isohexanoic, 2-ethylbutanoic, heptanoic, 2-methylhexanoic, isoheptanoic, neoheptanoic, octanoic, isooctanoic, 2-ethylhexanoic, nonanoic, isononanoic, 3,5,5,-trimethylhexanoic, decanoic, isodecanoic, neodecanoic, lauric, myristic, palmitic, palmitoleic, margaric, glycolic, lactic, salicylic, acetylsalicylic, stearic mandelic, isostearic, oleic, linoleic, linolenic, nonadecanoic, erucic, behenic acids and mixtures thereof.

According to another embodiment, the carboxylic acid is a dicarboxylic acid. Examples of dicarboxylic acids include, but are not limited to, maleic, tartaric, succinic, glutaric, adipic, sebacic, phthalic, isophthalic and terephthalic acids, dimer acids resulting from the polymerization of unsaturated fatty acids and generally contain an average from about 18 to about 44 carbon atoms and mixtures thereof.

In still another embodiment, the carboxylic acid is a tricarboxylic acid. Examples of tricarboxylic acids include, but are not limited to, trimellitic, citric, isocitric and agaicic acids, trimer acids resulting from the trimerization of unsaturated fatty acids and generally contain an average from about 18 to about 30 carbon atoms and mixtures thereof.

In addition to the polyetheramine salt discussed above, the fuel additive composition may further include one or more additional performance additives. These additional performance additives can be based on several factors such as the type of internal combustion engine and the type of hydrocarbonaceous composition being used in that engine, the quality of the hydrocarbonaceous composition, and the service conditions under which the engine is being operated. The additional performance additives can include an organic solvent, an antioxidant such as a hindered phenol or derivative thereof and/or a diarylamine or derivative thereof, a different corrosion inhibitor such as an alkenylsuccinic acid, including PIB succinic acid, and/or a detergent/dispersant additive, such as a Mannich base dispersant including: a reaction product of a hydrocarbyl-substituted phenol, an aldehyde, and an amine or ammonia; a polyisobutylene amine: or a glyoxylate.

Further additives can include, dyes, bacteriostatic agents and biocides, gum inhibitors, marking agents, and demulsifiers, such as polyalkoxylated alcohols. Other additives can include additional lubricity agents, such as fatty carboxylic acids, metal deactivators such as aromatic triazoles or derivatives thereof, and valve seat recession additives such as alkali metal sulfosuccinate salts. Additional additives can include, antistatic agents, deicers, combustion improvers such as an octane or cetane improver and fluidizers such as mineral oil and/or poly(alpha-olefins) and/or polyethers.

The polyetheramine salt may be present in the fuel additive composition in an amount of at least 0.5% by weight, or at least 1% by weight, or at least 10% by weight, or at least 20% by weight, or at least 30% by weight, or at least 40% by weight, or at least 50% by weight, or at least 60% by weight, or at least 70% by weight, or at least 80% by weight or at least 90% by weight, or even at least 99% by weight, based on the total weight of the fuel additive composition.

In another embodiment, the one or more additional performance additives may be present in the fuel additive composition of less than 90% by weight, or less than 50% by weight, or less than 20% by weight, or less than 10% by weight, or less than 1% by weight, based on the total weight of the fuel additive composition.

Exemplary fuel additive compositions are shown in the table below.

| Additive | Additive Package A (wt %) | Additive Package B (wt %) | Additive Package C (wt %) |
|---|---|---|---|
| Polyetheramine Salt | 0.1-50 | 0.5-30 | 1-10 |
| Organic Solvent | 0-70 | 0-40 | 0-20 |
| Fluidizer | 0-40 | 0-30 | 0-20 |
| Detergent | 0-70 | 20-60 | 30-50 |
| Demulsifiers | 0-5 | 0-3 | 0-1 |
| Other Corrosion Inhibitor | 0-3 | 0-2 | 0-1 |
| Other Friction Modifier | 0-20 | 0-15 | 0-10 |

According to another embodiment, there is provided a packaged product comprising: a) a container having at least an outlet; and b) the fuel additive composition.

According to one embodiment, the packaged product of the present disclosure comprises a container having a closure means, such as a lid, cover, cap, or plug to seal the container. In another embodiment, the sealed container also has a nozzle or pour spout. The sealed container may have the shape of a cylinder, oval, round, rectangle, canister, tub, square or jug and contains the fuel additive composition of the present disclosure.

In yet another embodiment, the container may be made from any material, such as steel, glass, aluminum, cardboard, tin-plate, plastics including, but not limited to, high density polyethylene (HDPE), polypropylene (PP), polyvinyl chloride (PVC), polyethylene terephthalate (PET), oriented polypropylene (OPP), polyethylene (PE) or polyamide and including mixtures, laminates or other combinations of these.

According to another embodiment, there is provided a fuel composition comprising the fuel additive composition and a hydrocarbonaceous composition.

In further embodiments, the fuel additive composition may be present in the fuel composition in an amount such that the polyetheramine salt is present in an amount of at least 10 ppm, 12 ppm, 25 ppm, 50 ppm, 100 ppm, 150 ppm, 200 ppm or 300 ppm, based on the total weight of the fuel composition. In other embodiments, fuel additive may be added to the fuel composition in an amount such that the polyetheramine salt is present in an amount of less than 5000 ppm, 2500 ppm, 2000 ppm, 1500 ppm, 1000 ppm, 750 ppm or 500 ppm, based on the total weight of the fuel composition.

In another embodiment, the hydrocarbonaceous composition is liquid at room temperature and is useful in fueling an engine. The hydrocarbonaceous composition can be a petroleum distillate to include a gasoline as defined by ASTM specification D4814, and in other embodiments the hydrocarbonaceous composition is a leaded gasoline or a nonleaded gasoline. The fuel composition may further include an oxygenate such as an alcohol, an ether, a ketone, an ester of a carboxylic acid, a nitroalkane, or a mixture thereof. For example, the fuel composition can include, for example, methanol, ethanol, butanol, methyl t-butyl ether, methyl ethyl ketone. In one embodiment, the fuel composition may comprise 0.1 vol % to 100 vol % oxygenate, based on a total volume of the fuel composition. In yet another embodiment, the fuel composition may comprise 0.1 vol % to 100 vol % hydrocarbonaceous composition, for e.g. gasoline, based on a total volume of the fuel composition. In yet another embodiment, the oxygenate may be ethanol. In other embodiments, the fuel composition may comprise gasoline and 5 vol % to 30 vol % ethanol, based on the total volume of fuel composition.

The fuel compositions may be prepared by combining the hydrocarbonaceous composition, the fuel additive composition, and oxygenates prior to putting the hydrocarbonaceous composition in a vehicle. For example, the fuel additive composition may be added and mixed together with the hydrocarbonaceous composition such that the polyetheramine salt is present at concentrations of at least 10 ppm or at least 20 ppm or at least 50 ppm or at least 100 ppm, based on the total weight of the fuel composition. The additized fuel composition may then be pumped into the fuel tank. In other embodiments, the fuel composition may be added to the fuel tank of a vehicle and the fuel additive composition comprising the polyetheramine salt may be added to a separate dosing tank in the vehicle which may then be dosed to the fuel composition at concentrations of at least 10 ppm as the vehicle is operating. This is known as "onboard dosing".

In one embodiment the fuel compositions described above are useful for liquid fuel engines and/or for spark ignited engines and can include engines for hybrid vehicles and stationary engines. The type of engine is not overly limited and includes, but is not limited to, V, inline, opposed, and rotary engines. The engines may be naturally aspirated, boosted, E-boosted, supercharged, or turbocharged engines. The engine may be a carbureted or fuel injected gasoline engine. As such, the engine may have a carburetor or injectors (including piezo injectors).

In one embodiment, the engine may be a gasoline direct injection ("GDI") engine (spray or wall guided, or combinations thereof), a port fuel injection ("PFI") engine, a homogeneous charge compression ignition ("HCCI") engine, stoichiometric burn or lean burn engines, spark controlled compression ignition ("SPCCI") engine, variable compression, Miller cycle or Atkinson cycle engines, or a combination thereof, such as an engine that contains both GDI and PFI injectors in the same engine. Suitable GDI/PFI engines includes 2-stroke or 4-stroke engines fueled with gasoline, a mixed gasoline/alcohol or any of the fuel compositions described in the sections above. The fuel composition can reduce corrosion, wear, and/or improve fuel economy of, an engine, such as a GDI or GDI/PFI engine. In yet other embodiments, the fuel compositions may be prepared using an on-board dosing system for either a GDI engine, a PFI engine, or a combination thereof.

In other embodiments any of the above engines may be equipped with a catalyst or device for treating exhaust emissions, such as reducing NOx. In other embodiments the engine may be a flexible-fuel engine able to operate on more than one fuel type, typically, gasoline and ethanol or gasoline and methanol. In yet other embodiments, any of the above engine types may be in a hybrid vehicle that also includes an electric motor.

Thus, in another embodiment, there is provided a method for preventing corrosion and wear reduction of a metal, plastic or synthetic part or surface of a fuel system component or internal combustion engine by combining an effective amount of the fuel additive composition with a hydrocarbonaceous composition to form a fuel composition, and contacting the metal, plastic or synthetic part or surface with the fuel composition during operation of the engine.

In general, the fuel additive composition may be added to the hydrocarbonaceous composition or gasoline in a minor amount, i.e., an amount effective to provide corrosion reduction and friction reduction to the gasoline. The fuel additive composition may be effective in an amount ranging from about 0.0002-0.2% by weight, based on the total weight of the gasoline. In some embodiments, an amount ranging from about 0.001-0.01% by weight, based on the total weight of the gasoline, may be preferred, the latter amounts corresponding to about 3 and 30 PTB (pounds of additive per 1000 barrels of hydrocarbon fuel or gasoline) respectively.

In yet another embodiment, there is provided a method for preventing corrosion and wear reduction of a metal, plastic or synthetic part or surface of a fuel system component or internal combustion engine by combining an effective amount of the fuel additive composition with a hydrocarbonaceous composition to form a fuel composition, and contacting the metal, plastic or synthetic part or surface with the fuel composition during operation of the engine.

It is known that prior to combustion, certain fuel additives can reach the thin film of lubricant that coats the cylinder wall and can, over time, accumulate in engine oil. It is therefore envisaged that in one embodiment, the polyetheramine salt of the fuel additive composition accumulates in engine oil. Thus, in one embodiment, the present disclosure provides an oil composition comprising an engine oil and the polyetheramine salt of the fuel additive composition as herein defined.

The present disclosure will now be further described with reference to the following non-limiting examples.

EXAMPLES

A High Frequency Reciprocating Rig (HFRR) was used to test friction reduction of the fuel additive compositions of the present disclosure in gasoline. The HERR was made by the PCS group. The gasoline was purchased from Haltermann Solutions (HF0437, Tier II EEE). The liquid loading volume was about 15 ml. The HERR tests in gasoline were carried out under the following conditions.

| | |
|---|---|
| Duration | 75 Minutes |
| Temperature | 25° C. |
| Frequency | 50 Hz |
| Stroke | 1 mm |
| Load | 200 g |
| Specimen | Steel AISI E-52100 |

To determine corrosion inhibitor performance, carbon steel coupons were sanded by sandpaper before use and half of the coupon was then immersed into the liquid fuel composition and maintained at a temperature of about 30° C. for 5 hours under agitation as further described below.

Synthesis of the Fuel Additive Compositions

The polyoxyalkylene monoamine or polyamine and carboxylic acid were mixed at an amine number to acid number of about 1:1 at ambient temperature for 60 minutes. The carboxylic acids included oleic acid, isosteric acid and dimer acid. The polyoxyalkylene monoamines and polyamines included JEFFAMINE® C-300, M-600 FL-1000, D-230, D-400 and T-3000 amine. The fuel additive compositions are summarized below in the following table.

| Name | Mixture |
|---|---|
| Ex. 1 | Isosteric acid + Jeffamine ® D-230 polyamine |
| Ex. 2 | Isosteric acid + Jeffamine ® D-400 polyamine |
| Ex. 3 | Isosteric acid + Jeffamine ® T-3000 polyamine |
| Ex. 4 | Oleic acid + Jeffamine ® D-230 polyamine |
| Ex. 5 | Oleic acid + Jeffamine ® T-3000 polyamine |
| Ex. 6 | Dimer acid + Jeffamine ® C-300 monoamine |
| Ex. 7 | Dimer acid + Jeffamine ® FL-1000 monoamine |
| Ex. 8 | Dimer acid + Jeffamine ® D-230 polyamine |

Evaluation of fuel additive compositions in gasoline at 0.15% (1500 ppm) salt dosage level by HFRR.

Examples 1 and 2 were blended with an additive free gasoline (HF0437) at a polyetheramine salt dosage level of 1500 ppm. The wear scar was measured according to ASTM D6709 for each Example and the results are shown below.

| Sample | Wear Scar (μm) |
|---|---|
| HF0437 | 773 |
| HF0437 + Ex. 1_1500 ppm | 238 |
| HF0437 + Ex. 2_1500 ppm | 242.2 |

Evaluation of fuel additive compositions in gasoline at 0.30% (300 ppm) salt dosage level by HFRR.

Examples 1, 3, 4, 5, 6 and 8 were blended with an additive free gasoline (HF0437) at a polyetheramine salt dosage level of 300 ppm. The wear scar was measured according to for each Example and the results are shown below.

| Sample | Wear scar (μm) |
|---|---|
| HF0437 | 773 |
| HF0437 + Ex. 1_300 ppm | 270 |
| HF0437 + Ex. 3_300 ppm | 368.5 |
| HF0437 + Ex. 4_300 ppm | 283.5 |
| HF0437 + Ex. 5_300 ppm | 304.5 |
| HF0437 + Ex. 6_300 ppm | 199.5 |
| HF0437 + Ex. 8_300 ppm | 236.5 |

Evaluation of fuel additive compositions in gasoline at 0.15% (150 ppm) salt dosage level by HFRR.

Examples 1, 3, 4, 5, 6 and 7 were blended with an additive free gasoline (HF0437) at a polyetheramine salt dosage level of 150 ppm. The wear scar was measured for each Example and the results are shown below.

| Sample | Wear scar (μm) |
|---|---|
| HF0437 | 773 |
| HF0437 + Ex. 1_150 ppm | 329 |
| HF0437 + Ex. 3_150 ppm | 435 |
| HF0437 + Ex. 4_150 ppm | 319 |
| HF0437 + Ex. 5_150 ppm | 340.5 |
| HF0437 + Ex. 6_150 ppm | 284.5 |
| HF0437 + Ex. 7_150 ppm | 400 |

As demonstrated above, the fuel additive compositions according to the present disclosure are capable of greatly reducing wear even at very low polyetheramine salt dosage levels.

Evaluation of the fuel additives composition's anti-rust performance in a gasoline/salt water mixture at a 0.10% (100 ppm) salt dosage level. 150 g HF0437 and 15 g seawater were blended before addition of the Examples as shown below. To determine corrosion inhibitor performance, carbon steel coupons were sanded by sandpaper before use and then half of the metal coupon was immersed into the liquid fuel additive and maintained at a temperature of about 30° C. for 5 hours under agitation

| Example | Additive dosage in HF0437/ Seawater mixture |
|---|---|
| A | None |
| B | 0.0165 g Fuel Additive Comp. C1* |
| C | 0.0165 g Fuel Additive Comp. C2* |
| D | 0.0165 g Ex. 4 |
| E | 0.0165 g Fuel Ex. 6 |
| F | 0.0165 g Fuel Ex. 7 |

*Fuel Additive Comps. C1 and C2 are mixtures of a polyoxyalkylene monoamine and a monocarboxylic acid Based on the results shown in FIG. 1, the fuel additive compositions according to the present disclosure provided anti-rust performance in the gasoline/seawater mixture and in particular, the inventive fuel additive compositions provided significantly better anti-rust performance than comparative fuel additive compositions C1 and C2.

Although making and using various embodiments of the present invention have been described in detail above, it should be appreciated that the present invention provides many applicable inventive concepts that can be embodied in a wide variety of specific contexts. The specific embodiments discussed herein are merely illustrative of specific ways to make and use the invention, and do not delimit the scope of the invention.

What is claimed is:

1. A fuel additive composition for reducing corrosion and increasing lubricity in hydrocarbonaceous compositions in contact with a fuel system component part or internal combustion engine comprising a polyetheramine salt obtained by either: (a) mixing a polyoxyalkylene monoamine and at least one of a dicarboxylic acid or a tricarboxylic acid;

wherein the polyoxyalkylene monoamine is a compound having a general formula:

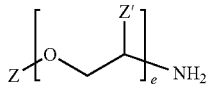

where Z is a $C_1$-$C_{40}$ alkyl phenol group; each Z' is independently hydrogen, methyl, or ethyl; and e is an integer from about 1 to about 50; and wherein the dicarboxylic acid comprises maleic acid, tartaric acid, succinic acid, glutaric acid, adipic acid, sebacic acid, phthalic acid, isophthalic acid, terephthalic acid, or a mixture thereof; and wherein the tricarboxylic acid comprises trimellitic acid, citric acid, isocitric acid, agaicic acid, or a mixture thereof.

2. The fuel additive composition of claim 1, wherein the polyetheramine salt is obtained by mixing the polyoxyalkylene monoamine and the dicarboxylic acid.

3. The fuel additive composition of claim 1, further comprising one or more performance additives.

4. A fuel composition comprising the fuel additive composition of claim 1 and a hydrocarbonaceous composition.

5. The fuel composition of claim 4, wherein the hydrocarbonaceous composition comprises gasoline.

6. The fuel composition of claim 5, further comprising an oxygenate.

7. The fuel composition of claim 6, wherein the oxygenate comprises ethanol.

8. The fuel composition of claim 7, wherein the fuel composition comprises ethanol in an amount of 5 vol % to 30 vol %, based on the total volume of the fuel composition.

9. A method for preventing corrosion and wear reduction of a metal, plastic or synthetic part or surface of a fuel system component or internal combustion engine comprising: combining an effective amount of a fuel additive composition comprising a polyetheramine salt obtained by either: (a) mixing a polyoxyalkylene monoamine and at least one of a dicarboxylic acid or a tricarboxylic acid;

wherein the polyoxyalkylene monoamine is a compound having a general formula:

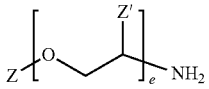

where Z is a $C_1$-$C_{40}$ alkyl phenol group; each Z' is independently hydrogen, methyl, or ethyl; and e is an integer from about 1 to about 50; and wherein the dicarboxylic acid comprises maleic acid, tartaric acid, succinic acid, glutaric acid, adipic acid, sebacic acid, phthalic acid, isophthalic acid, terephthalic acid, or a mixture thereof; and wherein the tricarboxylic acid comprises trimellitic acid, citric acid, isocitric acid, agaicic acid, or a mixture thereof; and contacting the metal, plastic or synthetic part or surface with the fuel composition during operation of the engine.

10. The method of claim 9, wherein the internal combustion engine is a gasoline direct injection engine.

* * * * *